United States Patent [19]

Smith

[11] Patent Number: 4,768,595

[45] Date of Patent: Sep. 6, 1988

[54] OIL RECOVERY APPARATUS USING AN ELECTROMAGNETIC PUMP DRIVE

[75] Inventor: Marty L. Smith, Iraan, Tex.

[73] Assignee: Marathon Oil Company, Findlay, Ohio

[21] Appl. No.: 848,501

[22] Filed: Apr. 7, 1986

[51] Int. Cl.[4] ..... E21B 43/00; F04B 17/04

[52] U.S. Cl. ..... 166/369; 166/66.4; 166/66.5; 166/68; 166/105; 166/381; 417/417

[58] Field of Search ..... 166/66.5, 66.4, 369, 166/381, 105, 108, 68; 417/417, 554

[56] References Cited

U.S. PATENT DOCUMENTS

| | | | |
|---|---|---|---|
| 1,199,921 | 7/1913 | Poth | 175/21 |
| 1,840,994 | 1/1932 | Winsor | 417/417 |
| 2,394,189 | 2/1946 | Kaufman | 166/369 |
| 2,555,112 | 5/1951 | Brown | 103/52 |
| 3,521,794 | 7/1970 | Bijl | 417/554 |
| 3,874,822 | 4/1975 | Nakamura | 417/311 |
| 4,284,943 | 8/1981 | Rowe | 318/806 |
| 4,291,761 | 9/1981 | Watson | 166/66 |
| 4,487,340 | 12/1984 | Shaffer | 417/417 X |
| 4,538,970 | 9/1985 | Rabson | 417/417 |
| 4,541,787 | 9/1985 | DeLong | 417/417 |
| 4,548,552 | 10/1985 | Holm | 417/417 |
| 4,687,054 | 8/1987 | Russell et al. | 166/64.4 |

FOREIGN PATENT DOCUMENTS

| | | | |
|---|---|---|---|
| 808737 | 2/1937 | France | 417/417 |

OTHER PUBLICATIONS

Craft, B. C., Holden, W. R., and Graves, Jr., E. D., 1962, Sucker Rod Pumping, Chapter 5, WELL DESIGN-Drilling and Production, Prentice-Hall, Inc., N.J., pp. 280-286.

*Primary Examiner*—Hoang C. Dang

*Attorney, Agent, or Firm*—Jack L. Hummel; Rodney F. Brown

[57] ABSTRACT

An apparatus for recovering oil from a subterranean hydrocarbon-bearing formation wherein a subsurface pump in the wellbore is driven by an electromagnet submersed in the wellbore above the pump.

16 Claims, 1 Drawing Sheet

OIL RECOVERY APPARATUS USING AN ELECTROMAGNETIC PUMP DRIVE

BACKGROUND OF THE INVENTION

1. Technical Field:

The invention relates to an apparatus for the recovery of oil and more particularly to a rodless pumping system using an electromagnetic pump drive to recover oil.

2. Description of Related Art:

Conventional oil recovery apparatus employ rod pumping systems. Rod pumping systems include a subsurface pump, a rod string, and a surface pumping unit. The surface pumping unit provides power to drive the subsurface pump. The rod string is the mechanical link between the surface pumping unit and subsurface pump which lifts a column of oil from the producing interval of a well to the surface via the well tubing. The rod string is a moving part which is subjected to considerable stress and wear, especially in deviated wells where the rod string is likely to come in contact with the tubing.

An oil recovery apparatus is needed which reduces the amount of wear on the rod string and tubing. A process is further needed which reduces the frequency of replacement of the rod string and the attendant cost of replacement.

SUMMARY OF THE INVENTION

The present invention relates to an oil recovery apparatus comprising a submersible electromagnetic pump drive which works in concert with a subsurface reciprocating pump to lift oil from the producing interval of a well to the surface. The subsurface pump is positioned in the well near the producing interval and the pump drive is positioned directly above it.

The apparatus operates on a continuous pumping cycle. In the upstroke, the electromagnetic pump drive is electrically energized from an external pump source creating a magnetic attraction on an electromagnetic plunger, drawing it upward toward the pump drive. As the electromagnetic plunger travels upward, it pulls a mechanically connected pump plunger with it. The pump plunger lifts oil from the producing interval of the well over the length of the pump stroke and simultaneously displaces an overhead column of oil upward in the well to the surface. The upward movement of the pump plunger creates a void in the well at the producing interval which in turn fills with newly produced fluid from the formation.

At the conclusion of the upstroke the electromagnetic plunger contacts the electromagnetic pump drive, which is then de-energized to begin the downstroke. The plunger falls downward under the force of gravity toward the producing interval and fills with the newly produced fluids therein. The downstroke is completed when the pump plunger reaches the producing interval. The cycle is repeated continually, producing oil stroke by stroke at the surface wellhead.

The present invention eliminates much of the equipment required in a conventional rod pumping system and the attendant disadvantages of the equipment. Specifically, the present invention eliminates the mechanical linkage, i.e., rod string, which transfers energy from surface pumping equipment to the subsurface pump. Instead the pump drive powers the pump by magnetic rather than mechanical force. By submersing the pump drive in the well, the prime mover and surface pumping unit of the conventional system are also eliminated.

The apparatus of the present invention functions effectively in both straight wells and deviated wells. The apparatus reduces wear on the tubing and rod string caused by movement of the rod string and thereby reduces production downtime required for replacement of worn production equipment. The net effect is increased productivity from the well and lower equipment costs.

DESCRIPTION OF PREFERRED EMBODIMENTS

Figure 1:
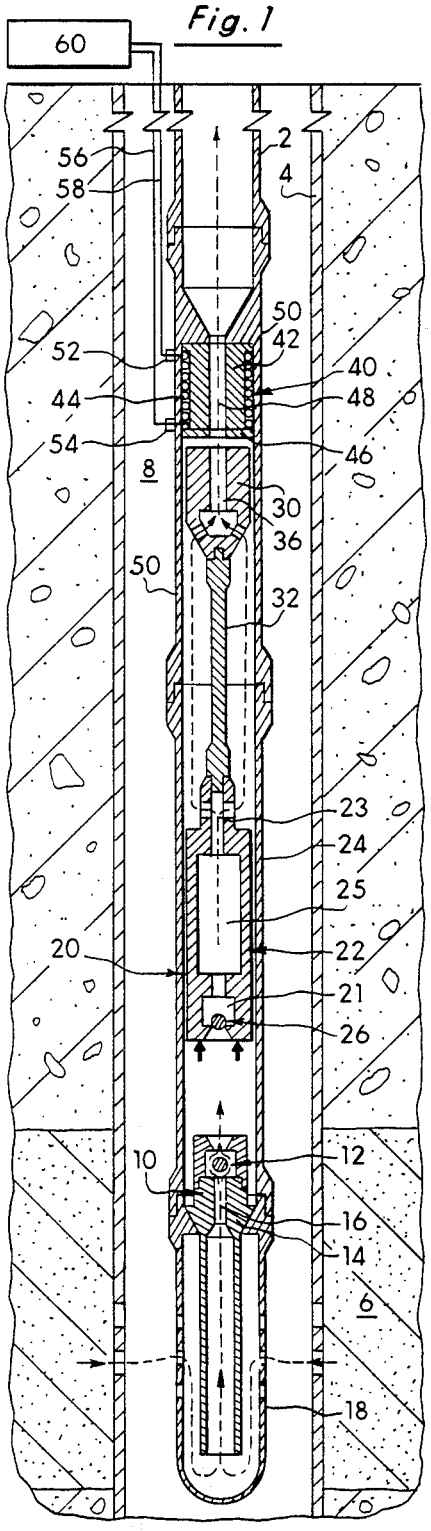
FIG. 1 shows an embodiment of the present invention in the upstroke of the pumping cycle.

The apparatus of the present invention is described with reference to FIG. 1. The apparatus is positioned in the tubing 2 of a cased wellbore above and adjacent to the producing interval 6 of the formation. The apparatus is comprised of two main components, the pump and the pump drive. The pump is comprised of a standing valve assembly 10 and traveling valve assembly 20. The particular pump configuration shown in FIG. 1 is a tubing-type pump.

The standing valve assembly 10 is located nearest the bottom of the tubing string 2. The assembly comprises a standing valve 12 and a shoe 14 below it which acts as a bottom anchor to maintain the standing valve 12 stationary relative to a pump plunger 22. The standing valve assembly 10 has a fluid passageway 16 which is regulated by the standing valve 12. The standing valve assembly optionally has a gas anchor 18 incorporated into the bottom end of the tubing string 2 which reduces the amount of gas being pumped with the oil. The gas anchor 18 is a perforated member at the producing interval 6 which enables oil to flow into the tubing 2 and pump 10, 20 while expelling gas from the tubing 2 for production via an annulus 8 between the casing 4 and tubing 2.

The traveling valve assembly 20 is located immediately above the standing valve assembly 10. The traveling valve assembly comprises a working barrel 24, an open-chambered pump plunger 22, and a traveling valve 26. The stationary working barrel 24 is an integral part of the tubing string 2 and encloses the pump plunger 22. The pump plunger 22 is movable relative to the standing valve assembly 10 and working barrel 24.

The pump plunger 22 has a chamber 25 with fluid passageways at the top 23 and bottom 21, opening into the working barrel 24. Fluid flow through the working barrel 24 is only possible across the pump plunger passageways 21, 23, 25 because a tight fit between the pump plunger 22 and working barrel 24 provides a seal against other flow paths. Flow across the pump plunger 22 is regulated by the traveling valve 26, which is shown as a ball and seat configuration at the bottom passageway 21 of the pump plunger.

Although the pump 10, 20 is described herein with reference to a tubing-type pump, other reciprocating or piston pumps known in the art may be used in conjunction with the present invention and fall within the scope thereof. Other pumps include insert pumps, top anchor pumps, traveling working barrel pumps, etc.

The pump drive comprises an electromagnetic plunger 30 and an electromagnet assembly 40. The pump drive 30, 40 is encased in a non-magnetic case 50 such as cast steel which is integrated into the tubing 2. The electromagnetic plunger 30 is mechanically linked to the lower-positioned pump plunger 22 by one or more weighted rigid sinker bars 32. The sinker bar 32 enables the two plungers 22, 30 to move in unison. The diameter of the sinker bar 32 is less than that of the tubing 2 so that fluids can flow through the tubing 2 around the sinker bar 32.

The electromagnetic plunger 30 is a broad-faced plunger which can fit flush against the electromagnet assembly 40. The electromagnetic plunger 30 is made of a magnetically attractable material such as soft iron or mild steel and has a fluid passageway 36 therethrough.

The electromagnet 40 is positioned above the electromagnetic plunger 30. The electromagnet 40 is held stationary relative to the electromagnetic plunger 30 by means such as a weld to the non-magnetic case 50.

The electromagnet 40 has a core 42 with a face plate 46 capable of fitting flush against the electromagnetic plunger. The face plate 46 may be an integral part of the core 42 or a separate shoe replaceable in the event of severe wear. The core 42 can be made of iron and the shoe 46 is advantageously made of a non-magnetic material such as a manganese steel alloy. The core 42 and shoe 46 have a fluid passageway 48 therethrough.

The core 42 is wrapped in a wire winding 44 or solenoid made of a conductive material such as anodized aluminum or strap copper. Fluid-tight lead connections 52, 54 in the non-magnetic case 50 connect the wire winding 44 by means such as cables 56, 58 to an external electrical power source 60 which may be on the surface. The cables 56, 58 may be run through the annulus 8 between the tubing 2 and the wellbore casing 4 to the power source 60.

Figure 2:
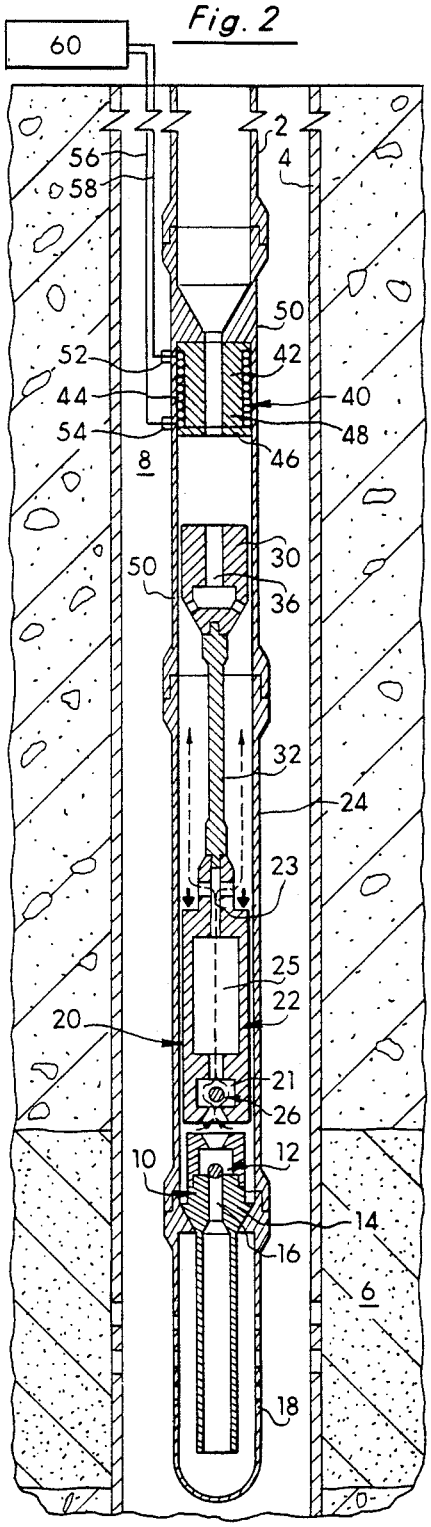
FIG. 2 shows an embodiment of the present invention in the downstroke of the pumping cycle.

Operation of the apparatus is described with reference to FIGS. 1 and 2. In FIG. 1, the pump 10, 20 is moving upward near the top of the upstroke. The movement of fluids is shown by dashed arrows and the movement of the pump is shown by a solid arrow.

In the upstroke, the electromagnet 40 is energized by transmitting a current from the external power source 60 through the winding 44. The electromagnet 40 draws the electromagnetic plunger 30 upward toward the face plate 46 of the electromagnet until the electromagnet 40 and plunger 30 are flush. Simultaneously, the pump plunger 22 moves upward. The fluid load on the pump plunger 22 closes the traveling valve 26, enabling the plunger 22 to displace oil from the tubing 2 to the surface. The upward motion of the pump plunger 22 also causes a pressure decrease above the standing valve 12, which opens the standing valve 12 and enables fluids from the formation 6 to enter the working barrel 24 below the pump plunger 22.

The downstroke begins when the electromagnet 40 and electromagnetic plunger 30 are flush. FIG. 2 shows the pump 10, 20 moving downward near the bottom of the downstroke. In the downstroke the current to the winding 44 of the electromagnet is terminated causing the electromagnetic plunger 30 and attached pump plunger 22 to drop in unison through the working barrel 24 until the pump plunger 22 meets the standing valve 12. The fluid in the working barrel 24 enters the pump plunger 22 via the traveling valve 26 which is open. The standing valve 12 is closed because it carries the weight of the fluid column above it in the tubing 2. The weight of the sinker bar or bars 32 can be adjusted to determine the rate at which the plungers 22, 30 fall through the working barrel 24. Once the pump plunger 22 reaches the standing valve 12, the downstroke is completed and a pumping cycle begins anew as the electromagnet 40 is re-energized.

The force exerted by the electromagnet 40 on the electromagnetic plunger 30 is a function of the magnetic conductivity of the core 42 and the number of times the winding 44 is wound around the core 42. The force required to lift oil to the surface is a function of the length of the pump stroke and the depth of the well. One skilled in the art can design the electromagnetic lift system of the present invention according to these criteria to produce oil from wells having different attributes. If additional lifting force is required beyond that which can be provided by a single electromagnetic pump drive and pump, additional pumps and drives can be placed in series at intervals along the length of the tubing to achieve the desired force.

While the foregoing embodiments of the invention have been described and shown, it is understood that all alternatives and modifications, such as those suggested and others apparent to one skilled in the art, may be made thereto and follow in the scope of the invention.

I claim:

1. An apparatus positioned in a tubular member within a wellbore for recovering oil from a subterranean oil-bearing formation, said apparatus comprising:

a reciprocating pump plunger means for pumping oil from the wellbore;

a magnetically attractable means positioned above said pump plunger means, said magnetically attractable means having a hollow fluid passageway therethrough and having an outer diameter substantially equal to but less than the inner diameter of said tubular member;

a linking means, which is substantially impermeable to flow of said oil therein, for mechanically linking said pump plunger means to said magnetically attractable means; and an electromagnetic means having a hollow fluid passageway therethrough and having an outer diameter substantially equal to said outer diameter of said magnetically attractable means, said electromagnetic means positioned above said magnetically attractable means for electromagnetically lifting said magnetically attractable means only as far as said electromagnetic means when said electromagnetic means is energized with an electric current and for providing a mechanical stop when said magnetically attractable means abuts said electromagnetic means.

2. The apparatus of claim 1 wherein said electromagnetic means is stationary relative to said tubular member and said magnetically attractable means is vertically slidable relative to said electromagnetic means.

3. The apparatus of claim 1 wherein said tubular member is a wellbore tubing.

4. The apparatus of claim 3 wherein said wellbore tubing, magnetically attractable means, and electromagnetic means define a continuous fluid passageway therethrough.

5. The apparatus of claim 1 wherein said electromagnetic means is an electromagnet having a core and a wire winding.

6. The apparatus of claim 1 wherein said magnetically attractable means is an electromagnetic plunger.

7. The apparatus of claim 1 wherein said linking means is a rigid solid metal bar.

8. An electromagnetic pump drive for driving a reciprocating pump plunger, said pump plunger and pump drive submerged in a wellbore penetrated by a tubing and containing a fluid being pumped from the wellbore via the tubing, said pump drive comprising:

an electromagnet having a core and a wire winding around said core, said electromagnet positioned in said tubing and having an outer diameter substantially equal to but less than the inner diameter of said tubing;

an electrical power source in electrical communication with said winding;

an electromagnetic plunger comprising a magnetically attractable material, positioned below said electromagnet, and having an outer diameter substantially equal to the outer diameter of said electromagnet, said electromagnetic plunger vertically slidable only as far as said electromagnet and said electromagnet providing a mechanical stop when said electromagnetic plunger abuts said electromagnet;

a mechanical linkage which is substantially impermeable to flow of said fluid therein between said electromagnetic plunger and the reciprocating pump plunger; and said tubing encasing said electromagnet and electromagnetic plunger and forming a continuous fluid passageway across said pump drive.

9. The apparatus of claim 8 wherein said electromagnetic plunger has a fluid passageway therethrough.

10. The apparatus of claim 9 wherein said electromagnet abuts said tubing to form a fluid seal therebetween.

11. A process for pumping a fluid from a subterranean fluid-bearing formation penetrated by a wellbore originating at an earthen surface, the process comprising:

(a) positioning an electromagnet in a production tubing within the wellbore such that said electromagnet substantially abuts said tubing to substantially prevent fluid flow between said tubing and electromagnet;

(b) positioning a reciprocating pump plunger in the tubing a vertical distance below said electromagnet such that said reciprocating pump plunger substantially abuts said tubing to substantially prevent fluid flow between said tubing and reciprocating pump plunger and such that the fluid occupies a volume in the tubing between said reciprocating pump plunger and electromagnet;

(c) energizing said electromagnet by providing an electric current to said electromagnet;

(d) drawing said reciprocating pump plunger upward in the tubing by a magnetic attraction between said energized electromagnet and a magnetically attractable member affixed to said reciprocating pump plunger until said electromagnet abuts said magnetically attractable member and said electromagnet mechanically stops an upward movement of said magnetically attractable member, said magnetically attractable member further substantially abutting said tubing to substantially prevent fluid flow between said tubing and magnetically attractable member;

(e) displacing the fluid occupying said volume upward relative to the surface by the upward motion of said reciprocating pump plunger;

(f) de-energizing said electromagnet by terminating said electric current thereto; and (g) dropping said magnetically attractable member and reciprocating pump plunger downward to said position in the tubing said vertical distance below said electromagnetic to displace additional fluid from the formation into said volume.

12. The process of claim 11 further comprising refilling said volume in the tubing with fluid from the formation after step (e).

13. The process of claim 12 further comprising repeating the process one or more times to displace the fluid through the tubing to the earthen surface.

14. The process of claim 13 wherein said fluid is displaced across said electromagnet via a fluid passageway therethrough.

15. The process of claim 13 wherein said fluid is displaced across said magnetically attractable member via a fluid passageway therethrough.

16. The process of claim 11 wherein said fluid comprises oil.

* * * * *